US012624489B2

(12) United States Patent
Kim et al.

(10) Patent No.: US 12,624,489 B2
(45) Date of Patent: May 12, 2026

(54) LAUNDRY TREATMENT APPARATUS

(71) Applicant: LG Electronics Inc., Seoul (KR)

(72) Inventors: Younghun Kim, Seoul (KR); Uikun Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 264 days.

(21) Appl. No.: 18/557,805

(22) PCT Filed: Apr. 26, 2022

(86) PCT No.: PCT/KR2022/005912

§ 371 (c)(1),
(2) Date: Oct. 27, 2023

(87) PCT Pub. No.: WO2022/231255

PCT Pub. Date: Nov. 3, 2022

(65) Prior Publication Data

US 2024/0240381 A1 Jul. 18, 2024

(30) Foreign Application Priority Data

Apr. 27, 2021 (KR) ..... 10-2021-0054394
Sep. 7, 2021 (KR) ..... 10-2021-0118838

(51) Int. Cl.
*D06F 37/26* (2006.01)
*D06F 37/22* (2006.01)
*D06F 23/02* (2006.01)

(52) U.S. Cl.
CPC ..... *D06F 37/265* (2013.01); *D06F 37/22* (2013.01); *D06F 37/26* (2013.01); *D06F 23/02* (2013.01)

(58) Field of Classification Search
CPC ..... D06F 37/265; D06F 37/22; D06F 37/26; D06F 23/02
See application file for complete search history.

(56) References Cited

U.S. PATENT DOCUMENTS

2006/0174666 A1* 8/2006 Je ..... D06F 37/265 68/23.2
2010/0175433 A1* 7/2010 Mancini ..... D06F 37/04 68/139
2016/0326687 A1* 11/2016 Jo ..... D06F 39/14
2020/0002870 A1* 1/2020 Choi ..... D06F 37/265
2020/0002877 A1* 1/2020 Jang ..... D06F 39/083
2020/0018007 A1* 1/2020 Davis ..... D06F 33/76
(Continued)

FOREIGN PATENT DOCUMENTS

CN 208121405 11/2018
CN 111850978 10/2020
(Continued)

OTHER PUBLICATIONS

Machine translation of CN 208121405 U to Zhang et al. (Year: 2018).*
(Continued)

*Primary Examiner* — Joseph L. Perrin
(74) *Attorney, Agent, or Firm* — Fish & Richardson P.C.

(57) ABSTRACT

A laundry treatment apparatus includes a load unit for adding more weight to a tub receiving water. The load unit is more expanded in volume than a cross-sectional shape of the tub so that more weight is added to the tub, resulting in reduction in vibration amplitude of the tub.

20 Claims, 7 Drawing Sheets

(56) References Cited

U.S. PATENT DOCUMENTS

| | | | | |
|---|---|---|---|---|
| 2020/0018008 | A1* | 1/2020 | Lee | D06F 37/261 |
| 2020/0063316 | A1* | 2/2020 | Kim | D06F 37/04 |
| 2020/0232140 | A1* | 7/2020 | Davis | D06F 33/00 |

FOREIGN PATENT DOCUMENTS

| | | | |
|---|---|---|---|
| EP | 1688526 | | 8/2006 |
| EP | 3591114 | A1 | 1/2020 |
| KR | 10-1302126 | | 6/2007 |
| KR | 20-0437186 | Y1 | 11/2007 |
| KR | 10-2020-0001494 | | 1/2020 |

OTHER PUBLICATIONS

Extended European Search Report in European Appln No. 22796088.7, mailed on Dec. 13, 2024, 8 pages.

International Search Report and Written Opinion in Appln. No. PCT/KR2022/005912, mailed on Aug. 16, 2022, 9 pages.

* cited by examiner

[Fig. 1]
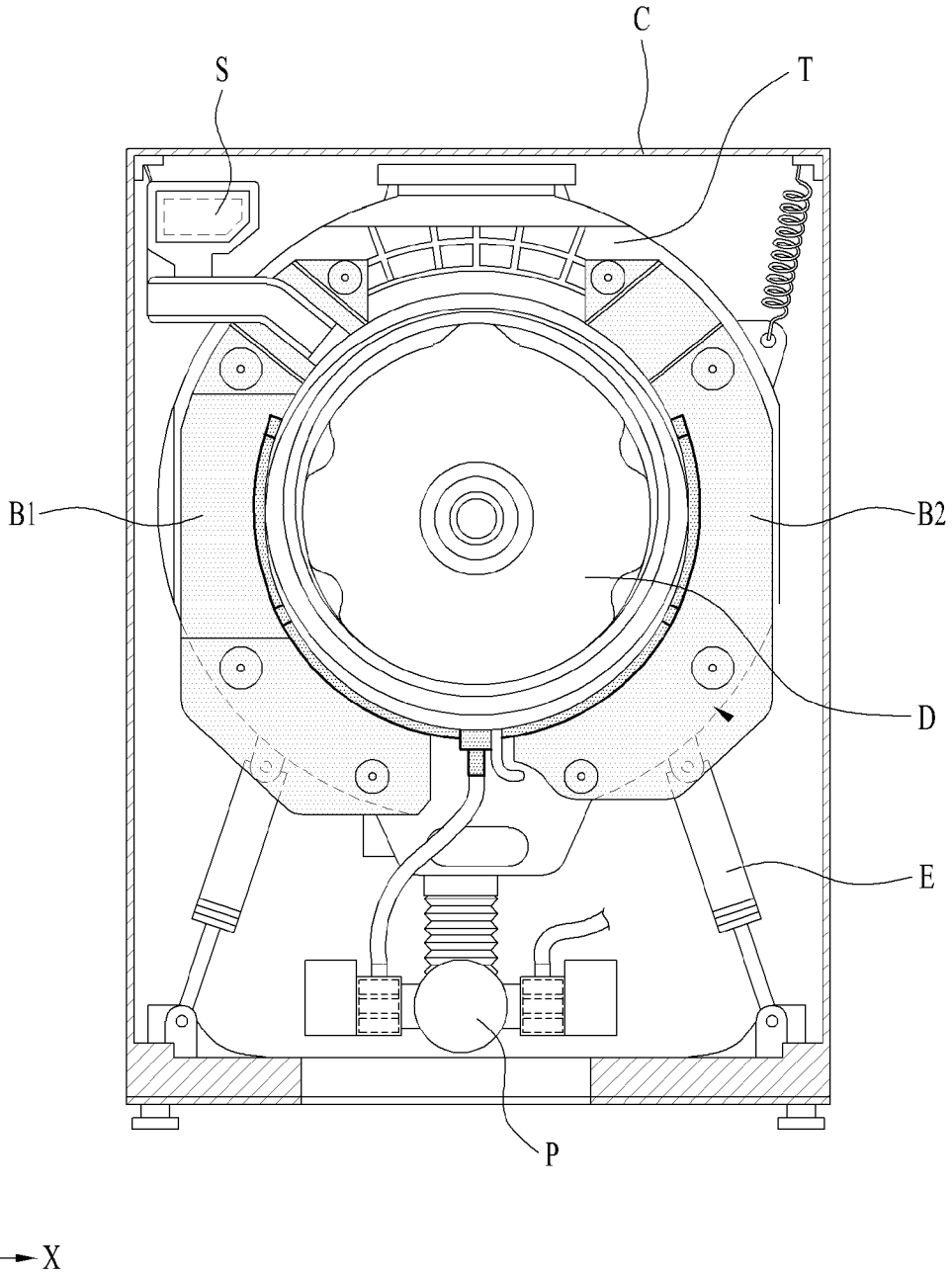

[Fig. 2]
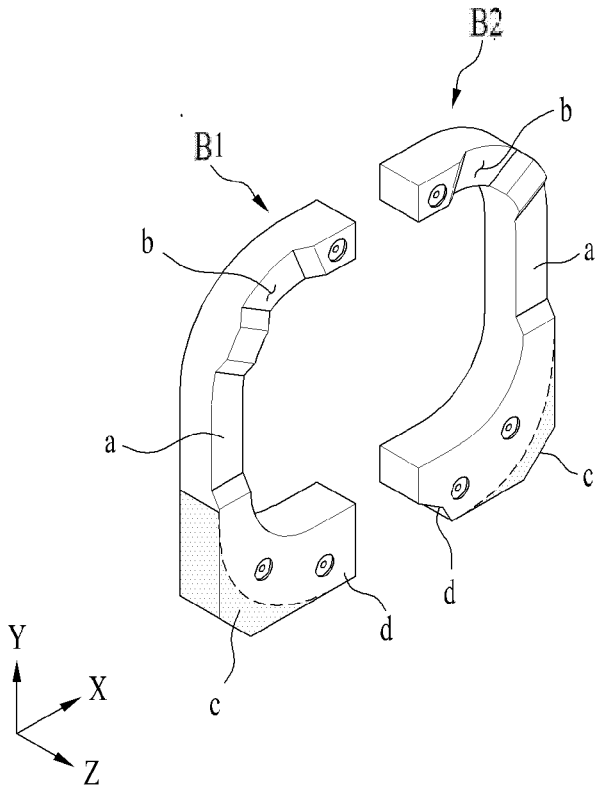

[Fig. 3]
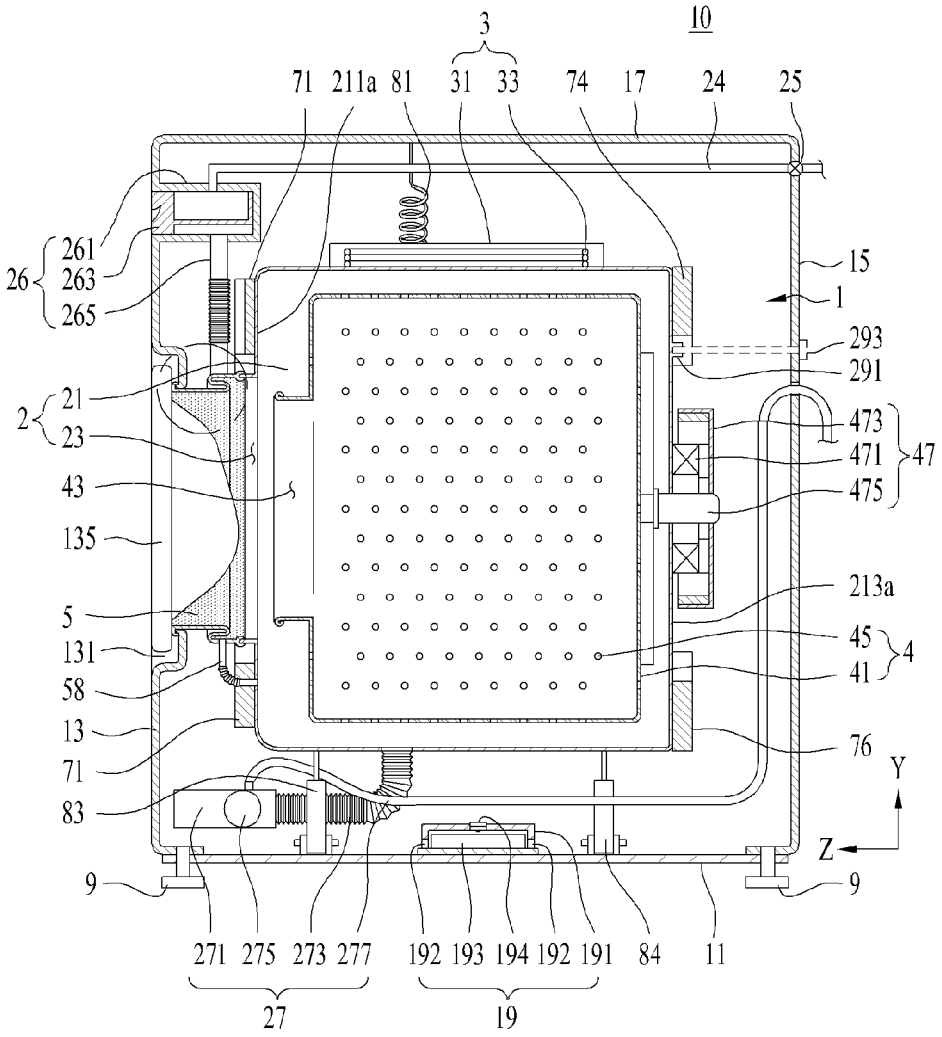

[Fig. 4]
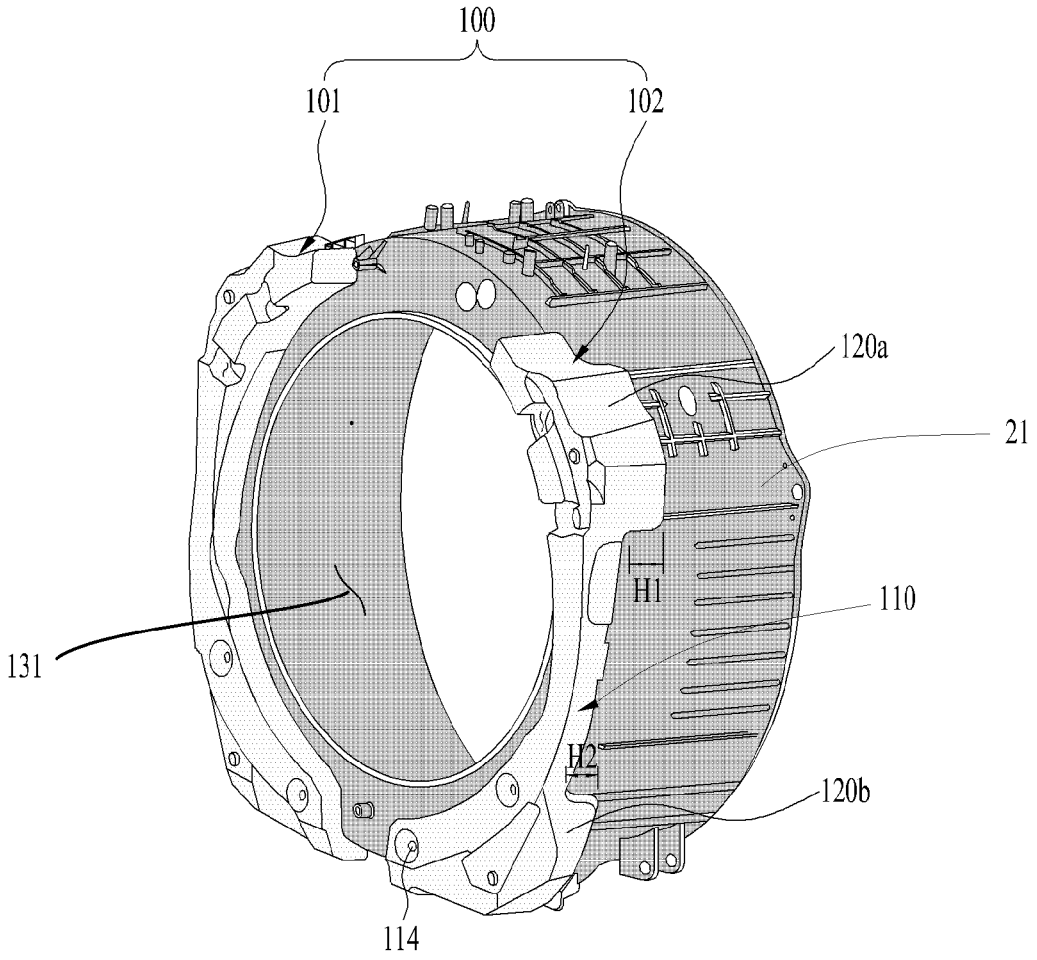

[Fig. 5]
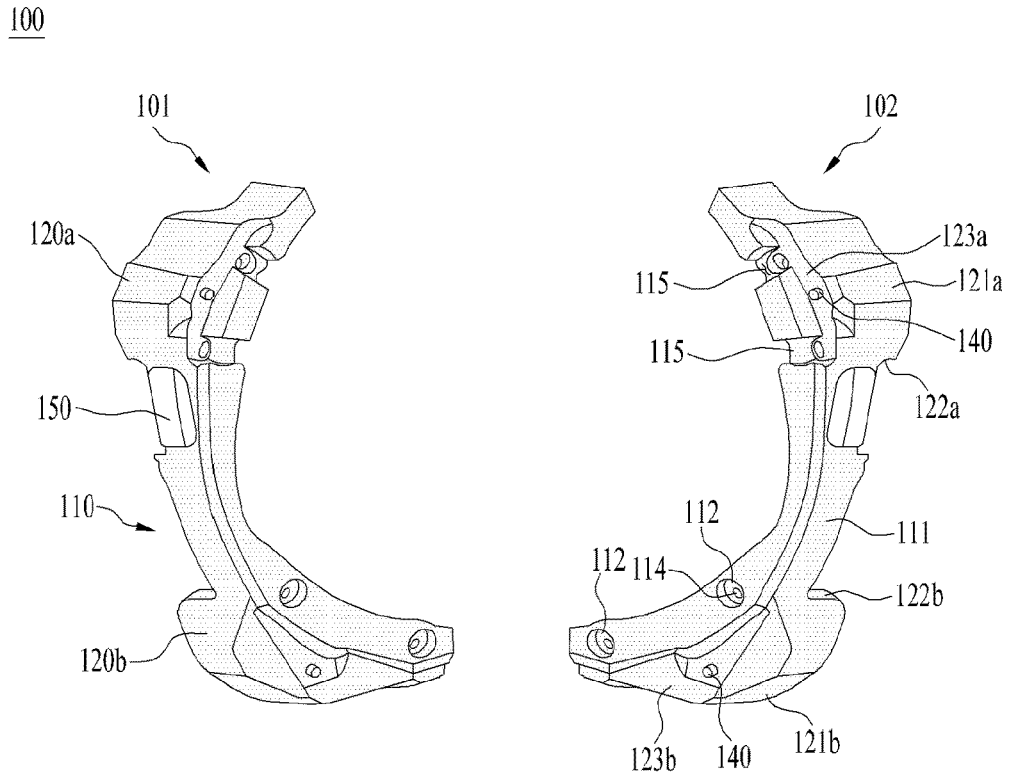
[Fig. 6]
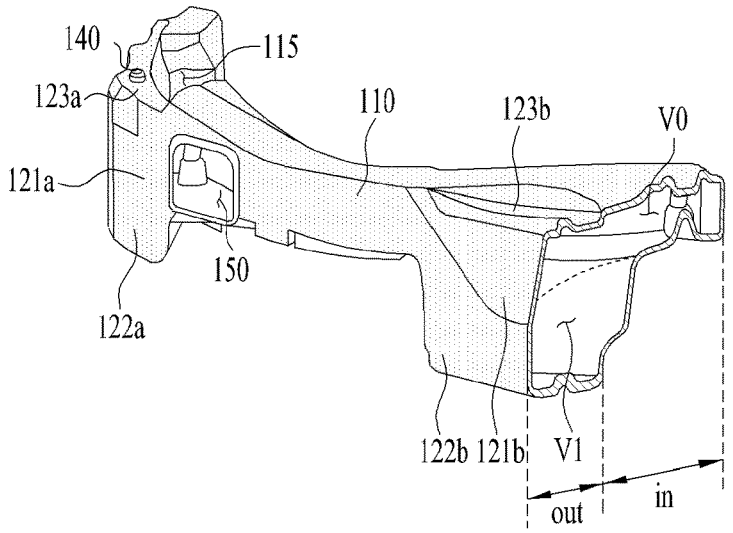

[Fig. 7]
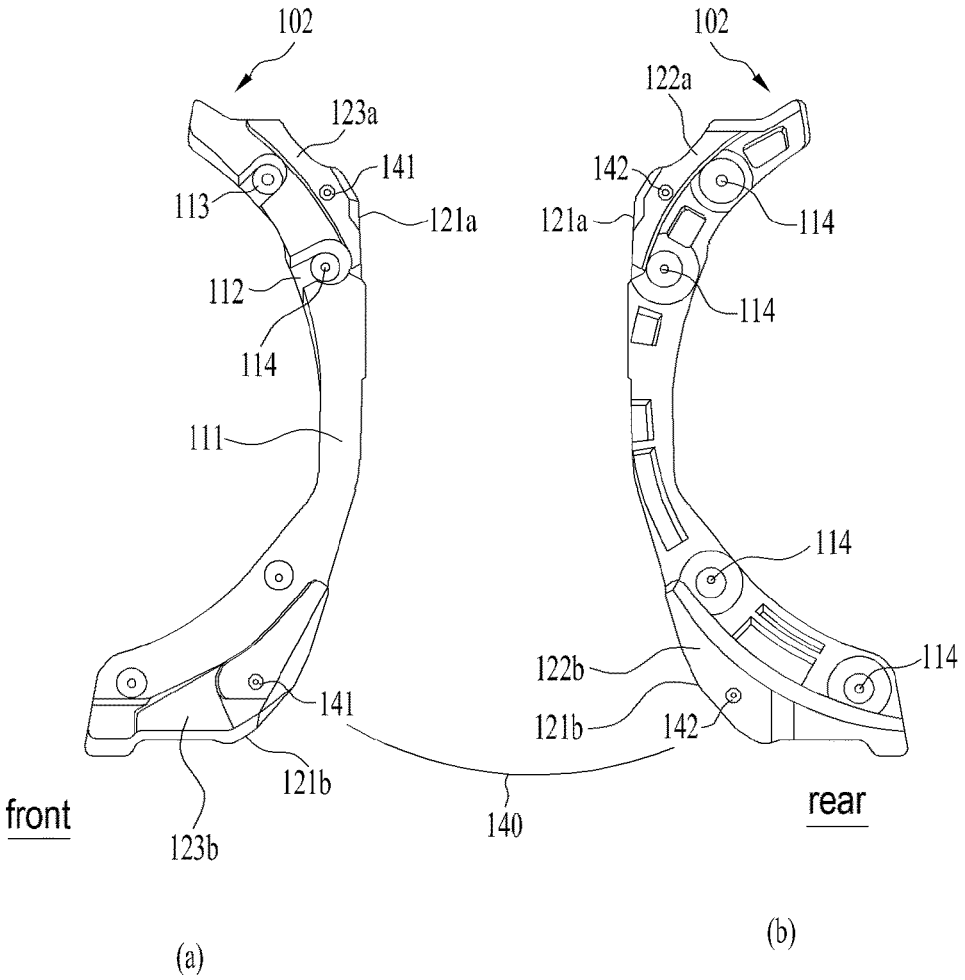
[Fig. 8]
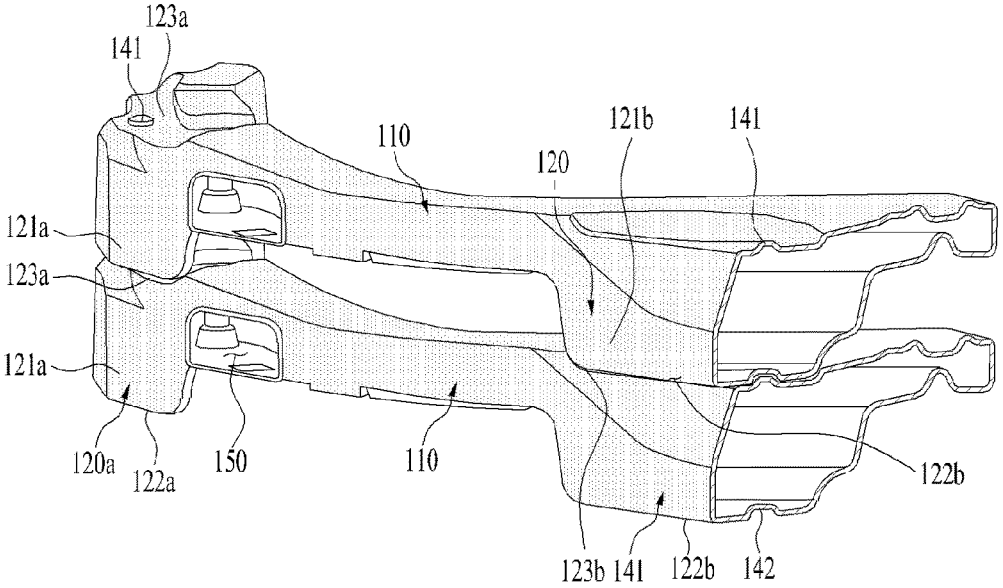

[Fig. 9]
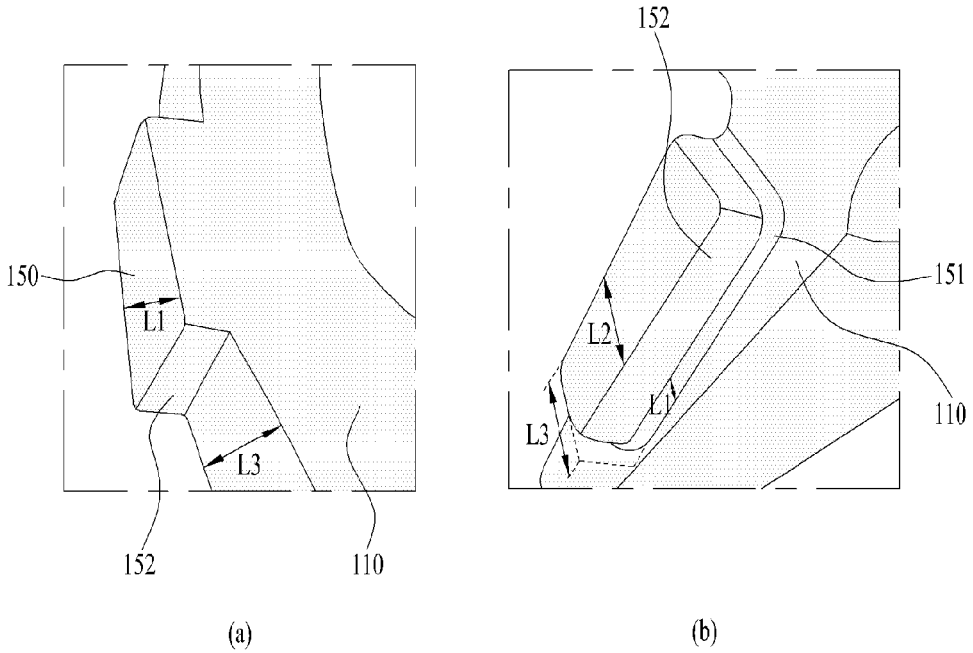
[Fig. 10]
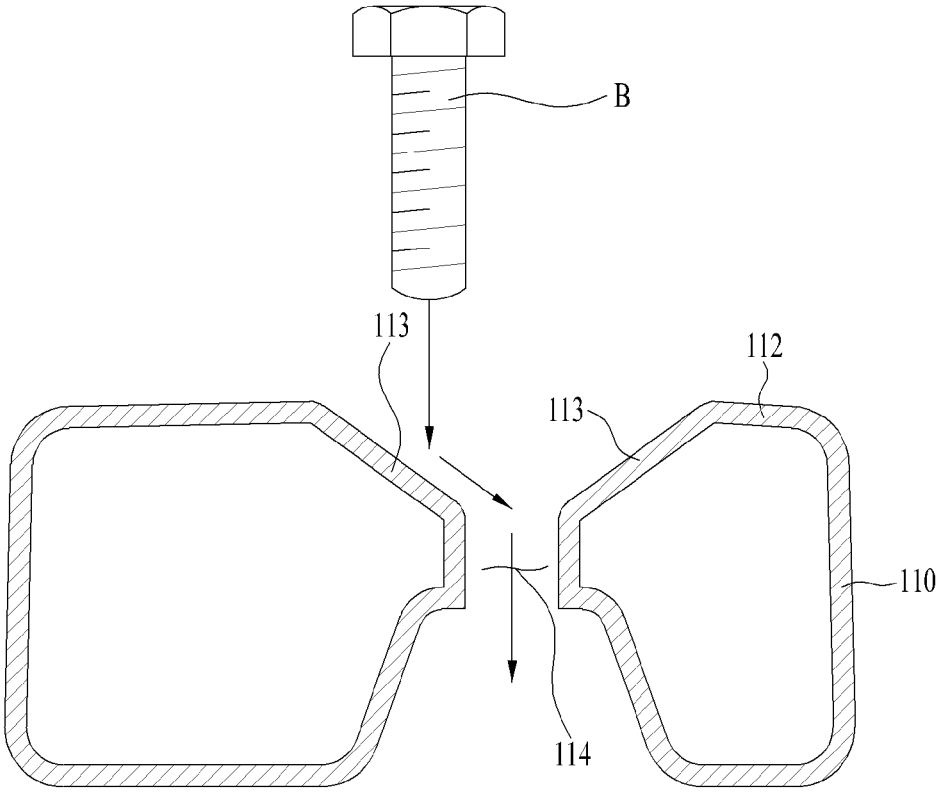

LAUNDRY TREATMENT APPARATUS

CROSS-REFERENCE TO RELATED APPLICATIONS

This application is a National Stage application under 35 U.S.C. § 371 of International Application No. PCT/KR2022/005912, filed on Apr. 26, 2022, which claims the benefit of Korean Application Nos. 10-2021-0118838, filed on Sep. 7, 2021, and 10-2021-0054394, filed on Apr. 27, 2021. The disclosures of the prior applications are incorporated by reference in their entirety.

TECHNICAL FIELD

The present disclosure relates to a laundry treatment apparatus, and more particularly to a laundry treatment apparatus in which a load unit for applying a load is installed to reduce the amplitude of vibrations generated inside the laundry treatment apparatus.

BACKGROUND

Generally, a laundry treatment apparatus may refer to an apparatus for washing laundry, an apparatus for drying wet or washed laundry, and/or an apparatus for performing washing and drying of laundry. Conventional laundry treatment apparatuses can be classified into a front-loading type laundry treatment device in which laundry is put into a tub through an inlet provided at a front surface of the front-loading type laundry treatment device, and a top-loading type laundry treatment device in which laundry is put into a tub through an inlet provided at a top surface of the top-loading type laundry treatment device.

FIG. 1 is a view showing a front structure of a conventional front-loading type laundry treatment apparatus.

Referring to FIG. 1, the conventional laundry treatment apparatus may include a cabinet C, a tub T disposed in the cabinet C, a drum D disposed in the tub T to rotate, and a support E for supporting the tub T in the cabinet C.

The tub T is connected to a water supply unit S to receive water, and a drain unit P is provided at a lower part of the tub T to drain washed or rinsed water to the outside.

The drum D rotates inside the tub T to provide mechanical force to laundry received in the drum D to wash laundry. When the laundry is completely washed, the drum D rotates at a high speed to remove moisture from the laundry, thereby dehydrating the wet or washed laundry.

The support E is provided with a damper, a spring, or the like. Thus, when vibration occurs while the drum D rotates, vibration of the tub T can be reduced (or damped).

However, in the conventional laundry treatment apparatus, laundry received in the drum D may be biased toward one side, thereby causing eccentricity of the laundry inside the drum D. In addition, in the conventional laundry treatment apparatus, when the drum D rotates at a high speed for laundry dehydration, or when a frequency generated in the tub T corresponds to a resonance frequency of the laundry treatment apparatus, vibration may occur greatly in the tub T.

It may be difficult to reduce (or damp) such vibration of the tub T only using the support E. As a result, the tub T may vibrate excessively and collide with the cabinet C, and there is a risk that the installation position of the tub T is unexpectedly changed or the support E is also damaged.

In order to address the above-described issues, the tub T of the conventional laundry treatment apparatus has been designed to further include a load unit B for adding the weight of the tub T to the tub B, thereby greatly reducing the amplitude of vibrations. The load unit B may be coupled to the tub T to increase the weight of the tub T, thereby greatly reducing the amplitude of vibrations generated in the tub T.

Since a driver for rotating the drum D is coupled to the rear of the tub T, the load unit B may be coupled to the front surface of the tub T.

Since the tub T receives water from the water supply unit S, the weight may be quite large. In this situation, when the load of the load unit B is not sufficient, there is a possibility that the load unit B does not sufficiently reduce (or damp) the vibration generated in the tub T.

As a result, the conventional laundry treatment apparatus can secure the load of the load unit B by further extending the area occupied by the load unit B.

FIG. 2 is a view illustrating a structure of the load unit B of the conventional laundry treatment apparatus.

Referring to FIG. 2, the load unit B may include a first load unit B1 and a second load unit B2 coupled to both sides of the inlet of the tub T.

Each of the first load unit B1 and the second load unit B2 includes a coupling body (a) coupled to the tub T, a seating groove (b) recessed in the coupling body (a) so that the water supply unit (s) or the like can be seated, and a coupling hole (d) through which a coupling member capable of being coupled to the tub T passes. As a result, the conventional load unit B can be fixed to the front surface of the tub T so that the load unit B can add a load to the tub T.

In addition, the conventional load unit B may include an extension unit C formed to extend further from the front surface of the tub T to the outside. As a result, the weight unit B may further secure a weight corresponding to the volume of the extension unit C.

However, when the extension unit C extends laterally from the coupling body (a), there is a risk that the extension unit C and the cabinet 1 collide with each other, so that there is a problem that the extension unit C cannot extend in the lateral direction of the coupling body (a).

In addition, when the extension unit C extends upward from the coupling body (a), there is a possibility that the extension unit C interferes with the water supply unit (s), the control panel, etc., and thus the extension unit C has difficulty in extending to the upper portion of the coupling body (a).

The tub T should be supported to be spaced apart from the ground by a predetermined length because the user has to put laundry into the tub T. In addition, a drain unit P should be installed at a lower portion of the tub T, so that a relatively large space can be provided to the lower portion of the tub T. As a result, the extension unit C of the conventional load unit B is generally provided to extend farther downward than the tub T.

However, when the extension unit (C) extends downward from the tub (T) in the same manner as the conventional load unit B, there is a problem that the volume of the load unit B cannot be sufficiently expanded.

Therefore, since the load unit B has no choice but to be formed of a metal or a material having a high specific gravity, there is a problem that the process of manufacturing the load unit B is complicated or production costs of the load unit B unavoidably increase.

In addition, when the extension unit C extends downward from the tub T, the load of the tub T and the drum D, the load of laundry and water may further overlap (may be more concentrated at) the lower portion of the tub T, or the center of gravity is more biased toward the lower portion of the tub T.

As a result, the conventional laundry treatment apparatus in which the conventional load unit B is installed has disadvantages in that the effect of reducing (or damping) vibrations of the tub T is degraded due to the presence of the load unit B.

In addition, the conventional laundry treatment apparatus has disadvantages in that the weight (load) of the load unit B is concentrated at a front lower portion of the tub T, so that stress generated when the front portion of the tub T sags is strengthened even when small impact is applied to the tub T or vibration occurs in the tub T, and the installation stability of the tub T cannot be guaranteed.

In addition, since the load unit B of the conventional laundry treatment apparatus is coupled or fixed only to the front of the tub T, there is a problem that coupling force between the load unit B and the tub T cannot be guaranteed.

In addition, the load unit B of the conventional laundry treatment apparatus is formed in a plate shape. When the plurality of plate-shaped load units B is stacked, sliding movement of the stacked load units B is facilitated, so that it is difficult to store or transport the stacked load units B.

SUMMARY

An object of the present disclosure is to provide a laundry treatment apparatus capable of increasing the weight of a load unit by expanding the volume of the load unit designed to add its own weight to a tub.

Another object of the present disclosure is to provide a laundry treatment apparatus capable of increasing the volume of the load unit without changing the shape of the tub or expanding the volume of the cabinet.

Another object of the present disclosure is to provide a laundry treatment apparatus capable of securing the weight of the load unit even when the load unit is filled with a material having a low specific gravity.

Another object of the present disclosure is to provide a laundry treatment apparatus capable of reducing the amplitude of vibration generated in the tub by moving the center of gravity of the tub upward.

Another object of the present disclosure is to provide a laundry treatment apparatus capable of increasing the coupling force between the load unit and the tub.

Another object of the present disclosure is to provide a laundry treatment apparatus that can be easily stored or transported by manufacturing the plurality of load units to be stacked.

In order to solve the above-described issues, the present disclosure provides a laundry treatment apparatus in which a load unit coupled to the front side of the tub extends to at least a portion of a side surface of the tub.

The load unit extends in a backward direction from the front side of the tub to the rear side of the tub along the side surface of the tub, thereby increasing the load added to the tub.

The load unit may extend from the upper and lower sides from among the side surfaces of the tub and may utilize an empty space between the tub and the cabinet. The load unit may be disposed while avoiding the region located closest to the side panel of the cabinet A laundry treatment apparatus includes a load unit. The load unit includes a load body disposed at both sides of the inlet in a forward direction from the tub; and an extension unit extending from the load body to surround at least a portion of a side surface of the tub.

The extension unit includes a first extension unit formed to protrude from the load body in a manner that the first extension unit extends toward the side surface of the tub; and a second extension unit spaced apart from the first extension unit in the load body, and formed to protrude from the load body in a manner that the second extension unit extends toward the side surface of the tub.

The first extension unit is provided to protrude from one end of the load body; and the second extension unit is provided to protrude from the other end of the load body. As a result, the first extension unit is disposed farther upward than the center of the inlet, and the second extension unit is disposed farther downward than the center of the inlet.

When the load body is coupled to the front side of the tub, the first extension unit is disposed farther upward than the second extension unit.

A protruded length of the first extension unit protruding from the load body is longer than a protruded length of the second extension unit protruding from the load body.

When the load body is coupled to the front side of the tub, the first extension unit is disposed farther upward than the second extension unit, and the first extension unit is disposed closer to the driver than the second extension unit.

The first extension unit has a larger volume than the second extension unit.

The extension unit includes an extension body that extends farther outward than an outer circumferential surface of the front side of the tub, wherein the extension body includes a protrusion formed to extend farther backward than the load body so as to surround at least a portion of the side surface of the tub; and a stack recess formed to be recessed or stepped in a front surface of the extension body such that a protrusion of another load unit is seated thereon.

The surface of the stack recess is formed in a shape corresponding to a cross-section of the protrusion.

The stack recess includes a fixing unit to which the protrusion is fixed; and the protrusion includes a seating portion that is provided to be seated in the fixing unit. The fixing unit is provided to protrude from the stack recess; and the seating portion is recessed in the protrusion to accommodate at least a portion of the fixing unit.

The extension unit includes: a first extension unit formed to protrude from the load body in a manner that the first extension unit extends toward the side surface of the tub; and a second extension unit spaced apart from the first extension unit in the load body, and formed to protrude from the load body in a manner that the second extension unit extends toward the side surface of the tub.

The first extension unit includes: a first extension body that extends farther outward than an outer circumferential surface of the front side of the tub; a first protrusion formed to extend farther backward than the load body so as to surround at least a portion of the side surface of the tub in the first extension body; and a first stack recess formed to be recessed or stepped in a front surface of the first extension body.

The second extension unit includes: a second extension body that extends farther outward than an outer circumferential surface of the front side of the tub; a second protrusion formed to extend farther backward than the load body so as to surround at least a portion of the side surface of the tub in the second extension body; and a second stack recess formed to be recessed or stepped in a front surface of the second extension body, The load unit further includes: an inlet through which a curing agent is injected into the load body, wherein the inlet has a smaller width than the load body.

The load unit includes: an extension surface formed to extend obliquely toward an outer circumferential surface of the inlet.

The load unit includes: a fastening unit provided in a manner that a fastening member coupled to the front side of the tub passes therethrough. The fastening unit includes a guide surface obliquely extending inward from the load body; and a fastening hole formed to penetrate an inner circumferential surface of the guide surface in a manner that the fastening member passes therethrough.

As is apparent from the above description, the laundry treatment apparatus according to the embodiments of the present disclosure can increase the weight of the load unit by expanding the volume of the load unit designed to add its own weight to the tub.

The laundry treatment apparatus according to the embodiments of the present disclosure can increase the volume of the load unit without changing the shape of the tub or expanding the volume of the cabinet.

The laundry treatment apparatus according to the embodiments of the present disclosure can secure the weight of the load unit even when the load unit is filled with a material having a low specific gravity.

The laundry treatment apparatus according to the embodiments of the present disclosure can reduce the amplitude of vibration generated in the tub by moving the center of gravity of the tub upward.

The laundry treatment apparatus according to the embodiments of the present disclosure can increase the coupling force between the load unit and the tub.

The laundry treatment apparatus according to the embodiments of the present disclosure can be easily stored or transported by manufacturing the plurality of load units to be stacked.

BRIEF DESCRIPTION OF THE DRAWINGS

FIG. 1 is a diagram illustrating a structure of a conventional laundry treatment apparatus.

FIG. 2 is a diagram illustrating a structure of a conventional load unit.

FIG. 3 is a diagram illustrating a structure of a laundry treatment apparatus according to the present disclosure.

FIG. 4 is a diagram illustrating a load unit of the laundry treatment apparatus according to the present disclosure.

FIG. 5 is a diagram illustrating a detailed structure of the load unit according to the present disclosure.

FIG. 6 is a cross-sectional view illustrating the load unit according to the present disclosure.

FIG. 7 is a diagram illustrating a front surface and a rear surface of the load unit according to the present disclosure.

FIG. 8 is a diagram illustrating a stacked structure of the plurality of load units according to the present disclosure.

FIG. 9 is a diagram illustrating an inlet structure provided in the load unit according to the present disclosure.

FIG. 10 is a diagram illustrating a fastening structure of the load unit according to the present disclosure.

DETAILED DESCRIPTION

Reference will now be made in detail to the embodiments of the present disclosure, examples of which are illustrated in the accompanying drawings. Wherever possible, the same reference numbers will be used throughout the drawings to refer to the same or similar parts. A singular expression may include a plural expression unless otherwise stated in the context. In the following description, a detailed description of related known configurations or functions incorporated herein will be omitted to avoid obscuring the subject matter. The accompanying drawings illustrate the exemplary embodiments of the present disclosure. The exemplary embodiments of the present disclosure are merely provided to describe the present disclosure in detail, and the technical range of the present disclosure is not limited by the exemplary embodiments.

FIG. 3 is a diagram illustrating a laundry treatment apparatus 10 according to the present disclosure. Referring to FIG. 3, the laundry treatment apparatus 10 may include a cabinet 1 and a laundry receiving unit provided inside the cabinet to receive laundry.

When the laundry treatment apparatus 10 is provided as a washing machine, the laundry receiving unit may include a tub 2 provided inside the cabinet to store water, and a drum 4 rotatably provided inside the tub 2 to store laundry.

In addition, when the laundry treatment apparatus 10 is provided as a dryer, the laundry receiving unit may have only a drum without a tub. Although the following description assumes that the laundry treatment apparatus 10 is provided as a washing machine for convenience of description, the scope or spirit of the present disclosure is not limited thereto, and it should be noted that the laundry treatment apparatus 10 can also be provided as a dryer.

The cabinet 1 may include a base 11 forming a bottom surface of the laundry treatment apparatus, a front panel 13 forming a front surface of the laundry treatment apparatus, a rear panel 15 forming a rear surface of the laundry treatment apparatus, an upper panel 17 forming an upper surface of the laundry treatment apparatus, and side panels that are fixed to the base to respectively form a left surface and a right surface of the laundry treatment apparatus and are respectively coupled to the upper panel 17 and the rear panel 15.

The front panel 13 may be fixed to at least one of the base 11 and the side panels, and the front panel 13 may be provided with an inlet 131 through which laundry can be put into or taken out of the drum. The inlet 131 may be opened and closed by a door 135.

The side panel(s) and the rear panel 15 may be formed integrally with each other. That is, the side panel(s) and the rear panel may be provided by bending one plate into a shape corresponding to the edge of the base 11.

The tub 2 may include a cylindrical tub body 21 having an empty inside, a front cover 211*a* fixed to the tub body to form a front surface of the tub, and a rear cover 213*a* fixed to the tub body to form a rear surface of the tub.

The front cover 211*a* may be disposed in a direction toward the front panel 13, and the rear cover 213*a* may be disposed in a direction toward the rear panel 15. A tub inlet 23 communicating with the inlet 11 may be provided in the front cover 211*a*.

The inlet 11 and the tub inlet 23 may be connected through a vibration insulation unit 5, and the vibration insulation unit 5 is preferably formed of an elastic material such as rubber.

The vibration insulation unit 5 may be provided to minimize vibration that is generated in the tub body 21 and transmitted to the cabinet 1.

In order to prevent water from remaining inside the vibration insulation unit 5, the laundry treatment apparatus according to the present disclosure may further include a residual water discharge pipe 58 for guiding water inside the vibration insulation unit 5 to the tub body 21.

The laundry treatment apparatus 10 may further include a support 8 for supporting the tub body 21 in the cabinet 1.

The support 8 may include a damper 84 for supporting the load of the tub body 21 and damping vibration received from the tub body 21. The damper 84 may be coupled to the base 11 to support a bearing housing coupled to a lower portion of the tub body 21 or the driver 47.

In addition, the support 8 may include a spring 81 that is coupled to the side panel or the upper panel 17 so as to provide force required to move the tub body 21 upward.

The tub body 21 may receive water through the water supply unit, and the water stored in the tub body can be discharged to the outside of the cabinet 1 through the drain unit. The water supply unit may include a water supply pipe 24 for connecting the water supply source to the tub body 21, and a water supply valve 25 for opening or closing the water supply pipe according to a control signal of the controller (not shown).

When a detergent supply unit 26 for supplying detergent to the tub body 21 is provided in the laundry treatment apparatus 10, the water supply pipe 24 may be provided to supply water to the detergent supply unit 26.

The detergent supply unit 26 may include a case 261 fixed to the inside of the cabinet 1, a drawer 263 that can be withdrawn from the case to the outside of the cabinet 1, and a connection pipe 265 for connecting the bottom surface of the case to the vibration insulation unit 5.

The drawer 263 may include a storage unit for providing a space in which detergent is stored, and a siphon passage provided in the storage unit to discharge liquid inside the storage unit to the case 261 when the level of stored water exceeds a predetermined reference level. In this case, the water supply pipe 24 may be provided to supply water to the storage unit of the drawer. The user can withdraw the drawer 263 from the case 261 through a drawer entrance (not shown) provided to penetrate the front panel 13.

The drain unit 27 may include a chamber 271 located inside the cabinet 1, a first drain pipe 273 for guiding water stored in the tub body 21 to the chamber 271, a pump 275 for pressurizing the water introduced into the chamber 271, and a second drain pipe 277 for guiding the water discharged from the pump to the outside of the cabinet 1.

The drum 4 may be provided with an empty cylindrical drum body 41. A drum inlet 43 may be provided on the front surface (facing the front cover) of the drum body 41. The drum inlet 43 may be provided at a position corresponding to the tub inlet 23 (the drum inlet is provided to communicate with the tub inlet). Therefore, laundry supplied through the tub inlet 23 can move to the drum body 41 through the drum inlet 43.

The drum 4 may further include a plurality of communication holes 45 formed to penetrate the drum body 41, and the communication hole 45 may enable the tub body 21 to communicate with the drum body 41. Therefore, water stored in the tub body 21 can flow into the drum body 41 through the communication hole 45, and water inside the drum body 41 can flow into the tub body 21 through the communication hole 45.

The drum 4 may be rotated by the driver 47. The driver 47 may include a stator 471 fixed to the rear cover 213*a* and located outside the tub body 21, a rotor 473 rotated by a rotating magnetic field provided by the stator, and a rotary shaft 475 formed to penetrate the rear cover 213*a* to interconnect the drum body 41 and the rotor 473.

The laundry treatment apparatus 10 may further include a heating unit 3 for drying laundry. The heating unit 3 may include a housing 31 fixed to the circumferential surface of the tub body 21, and a coil 33 that is fixed inside the housing and thus generates an eddy current in the drum body 41 upon receiving a current.

The present disclosure may further include a fixing unit for preventing the tub body 21 from colliding with the cabinet 1 during transportation of the laundry treatment apparatus 10. The fixing unit is a means for connecting the rear cover 213*a* to the rear panel 15 of the cabinet, and may be provided as a fixing bolt 293 that is fastened to a boss 291 by penetrating the rear panel 15 of the cabinet. When such transportation is completed, the fixing bolt 293 can be separated from the cabinet 1.

In the present disclosure, a water leakage detection sensor 19 may be further provided. The water leakage sensor 19 may determine whether water supplied into the tub body 21 leaks to the base 11. The water leakage detection sensor 19 may include a cylindrical housing 191 fixed to the base 11, a plurality of inlets 192 for allowing the receiving space provided inside the housing to communicate with the outside, an actuator 193 located inside the receiving space, and a sensing unit 194 fixed to the upper end of the housing 191. When water leaks to the base 11, the actuator 193 moves toward a top surface of the housing 191 by buoyancy of the water, and when the actuator 193 contacts the sensing unit 194, the sensing unit 194 may be provided to transmit a signal to a controller (not shown). In this case, the controller may be provided to stop the operation of the driver 47 and notify the user of water leakage through a display unit (not shown) or a speaker provided in the cabinet. The water leakage detection sensor 19 may be provided at the lowest position among the spaces provided by the base 11 so that water leakage can be immediately detected.

Meanwhile, when the drum 4 rotates in a state in which laundry is put into the drum 4, the eccentricity of laundry may occur or laundry tumbling caused by gravity may occur, so that vibration may occur in the tub 2.

In addition, when the drum 4 rotates in a state in which water is stored in the tub 2 due to a washing or rinsing cycle, vibration may occur inside the tub 2 due to a vortex, swell effect, and the like.

Moreover, when the drum 4 rotates at a high speed due to the dehydration cycle, vibration may occur in the tub 2 because the drum 4 unavoidably rotates in a state in which eccentricity of the laundry occurs. Even when the drum 4 passes through the resonant frequency region in a situation in which the rotation speed of the drum 4 is accelerated, strong vibration may occur in the tub 2.

In this way, when strong vibration is transmitted to the tub 2, the support 8 does not attenuate (or damp) all the vibration, so that the tub 2 may collide with the cabinet 1 or components (such as the vibration insulation unit 5 or the like) disposed between the tub 2 and the cabinet 1 may be unexpectedly damaged.

Therefore, the laundry treatment apparatus may include a load unit 100 capable of increasing the weight of the tub 2 in order to reduce the amplitude of vibration generated in the tub 2.

Since the weight of the tub 2 is further added to the load unit 100, the amplitude of vibration generated in the tub 2 can be greatly reduced.

The load unit 100 may be coupled to the front or rear side (having a smaller curvature) of the tub body 21 rather than the side surface of the tub body 21.

The load unit 100 may be fixed to be spaced apart from the inlet 131 or the vibration insulation unit 5 in a forward direction of the tub 2.

Of course, when the load unit 100 does not interfere with the driver 47, the load unit 100 can be disposed at the rear side of the tub 2. However, since the amplitude of vibration generated in the front side of the tub 2 is larger than the amplitude of vibration generated in the rear side of the tub 2, the load unit 100 coupled to the front side of the tub 2 may have a higher weight.

If the density of the load unit 100 coupled to the rear side of the tub 2 is similar to the density of the load unit 100 coupled to the front side of the tub 2, the load unit coupled to the front side of the tub 2 may be manufactured to have a larger volume than the load unit 100 coupled to the rear side of the tub 2.

The load unit 100 can be formed of a material having a high specific gravity, but in order to reduce production costs, the load unit 100 may be formed in a case shape that can be filled with a curing agent having a high specific gravity.

For example, the load unit 100 may be provided as a hollow cylindrical shape formed of a resin-based material, and a curing agent such as cement may be injected into the load unit 100 so that the load unit 100 can be filled with the curing agent.

FIG. 4 is a diagram illustrating the load unit 100 of the laundry treatment apparatus according to the present disclosure.

Referring to FIG. 4, the load unit 100 may be coupled to the front side of the tub body 21, so that the weight of the tub 2 can be added to the tub body 21.

The load unit 100 may be spaced outward from the inlet 131 so as not to shield the inlet 131.

The load unit 100 may be formed in a ring shape or an annular shape surrounding the inlet 131. However, in this case, it may sometimes be difficult for the load unit 100 to be completely filled with the curing agent.

Therefore, the load unit 100 may be formed in an arc-shaped bar shape.

The load unit 100 may be disposed outside the inlet 131 to prevent interference with the inlet 131. In order to prevent the center of gravity from being concentrated to one side with respect to the inlet 131, the load unit 100 may be provided symmetrical to the inlet 131.

The load unit 100 may be disposed above and below the inlet 131. However, it is preferable that the load unit 100 be disposed at both sides of the inlet 131, so that the load unit 100 disposed at both sides of the inlet 131 can be prevented from interfering with the control box or the like and the left and right vibrations of the tub 2 may not be problematic.

The load unit 100 may include a first load unit 101 coupled to the front side of the tub 2 at the left side of the inlet 131, and a second load unit 102 coupled to the front side of the tub 2 at the right side of the inlet 131.

The first load unit 101 and the second load unit 102 may be arranged symmetrical to each other while being installed at different positions. Of course, the term "symmetry" may refer to a level at which a person skilled in the art can recognize the morphological similarity, and may not mean perfect line symmetry.

Each of the first load unit 101 and the second load unit 102 may include a load body 110 provided along the outer circumferential surface of the inlet 131 and coupled to the front of the tub body 21.

The load body 110 may be provided in an arc-shaped bar that is spaced apart from the inlet 131. The inner surface of the load body 110 may maximally extend to the outer circumferential surface of the inlet 131, and the outer surface of the load body 110 may extend to the outer circumferential surface of the front side of the tub body 21.

The total length of the load body 110 may be longer than the diameter of the inlet 131 and shorter than the diameter of the front side of the tub body 21, and the thickness of the load body 110 may be greater than or equal to the length of the inlet 131 protruding from the tub body 21.

On the other hand, the load unit 100 may further include an extension unit 120 extending from the load body 110 to expand the volume of the load unit 100.

The extension unit 120 may be provided to extend outward from the load body 110 so that the volume of the load unit 100 can be expanded more than the load body 110, thereby increasing the weight of the load unit 100.

The extension unit 120 may be provided to extend from the load body 110 toward the front outer circumferential surface of the tub body 21.

Depending on the front shape of the inlet 131 or the tub body 21, either the spacing between both ends of the load body 110 or the central portion of the load body 110 may be located closer to the cabinet 1 than both ends of the load body 110.

In other words, since the spacing between both ends of the load body 110 and the cabinet 1 is secured relatively wide, the extension unit 120 may extend from both ends of the load body 110.

On the other hand, since the spacing between the outer circumferential surface of the load body 110 and the cabinet 1 is relatively limited, the extension unit 120 may be provided such that the length extending from the load body 110 toward the side surface of the tub 2 may be longer than the length extending from the load body 110 toward the cabinet 1.

That is, the extension unit 120 may be provided to utilize the space disposed in forward and backward directions between the cabinet 1 and the upper and lower portions of the side surface of the tub 2.

As a result, the extension unit 120 can be expanded to a sufficient volume without being limited to the spacing between the side surface of the tub 2 and the cabinet 1, and as a result, the load unit 100 of the laundry treatment apparatus 10 can add a sufficient load to the tub 2.

The extension unit 120 may extend from the load body 110 to surround at least a portion of the side surface of the tub 2. The extension unit 120 may protrude from the load body 110 toward the driver 47 or the rear side of the load body 110.

The extension unit 120 may include a first extension unit **120*a* protruding from one end of the load body 110 toward the side surface of the tub 2, and a second extension unit 120*b* protruding from the other end of the load body 110 toward the side surface of the tub 2**.

The first extension unit **120*a* and the second extension unit 120*b*** may be spaced apart from each other.

When the load body 110 is coupled to the front side of the tub 2, the first extension unit **120*a* may be disposed above the second extension unit 120*b***.

As a result, the first extension unit **120*a* and the second extension unit 120*b* may be respectively disposed above and below a region located closest to the side panel of the cabinet 1 from among the side surfaces of the tub body 21**.

In other words, the first extension unit **120*a* may be disposed at the center of the inlet 131 or may be disposed above a rotary shaft of the driver 47. The second extension unit 120*b* may be disposed below the center of the inlet 131 or the rotary shaft of the driver 47**.

The first extension unit 120*a* and the second extension unit 120*b* may be provided to surround the tub 2, and may be provided to contact the side surface of the tub 2. The inner shapes of the first and second extension units 120*a* and 120*b* may correspond to the outer shapes of the side surfaces of the tub 2. Accordingly, the first extension unit 120*a* and the second extension unit 120*b* are in close contact with the side surface of the tub 2 so that the load unit 100 can be fixed to the tub 2. As a result, the spacing between the load unit 100 and the tub 2 can be prevented from occurring, thereby preventing the load unit 100 and the tub 2 from colliding with each other when the load unit 100 and the tub 2 vibrate.

On the other hand, a first length H1 by which the first extension unit 120*a* protrudes from the load body 110 may be set longer than the second length H2 by which the second extension unit 120*b* protrudes from the load body 110.

Accordingly, the length of the first extension unit 120*a* covering the side surface of the tub body 21 may be longer than the length of the second extension unit 120*a* covering the side surface of the tub body 21.

Even if the front area of the first extension unit 120*a* is smaller than the front area of the second extension unit 120*b*, the first extension unit 120*a* protrudes from the load body 100 so that the first extension unit 120*a* is located closer to the driver 47 than the second extension unit 120*b*, and thus the upper portion of the load unit 100 can be set to be heavier.

As a result, the center of gravity of the load unit 100 can move upward from the tub body 21, and the load of the tub 2 can be prevented from being shifted to the front lower side of the tub 2.

Therefore, the vibration amplitude of the tub 2 can be more effectively reduced, and even when the tub 2 vibrates, the width of the tub 2 vibrating toward the front lower side of the tub 2 is reduced, so that the structure disposed outside the tub 2, such as the vibration insulation unit 5, can be prevented from being damaged or broken.

Meanwhile, the volume of the first extension unit 120*a* may be larger than the volume of the second extension unit 120*b* so that the load unit 100 can move the center of gravity of the front side of the tub 2 upward.

FIG. 5 is a diagram illustrating a specific structure of the load unit 100.

Referring to FIG. 5, the first load unit 101 and the second load unit 102 may commonly include a load body 110 coupled to the front side of the tub body 21, and an extension unit 120 extending from both ends of the load body 110 to expand the volume of the load unit 100.

Each of the load body 110 and the extension unit 120 may be formed in a case shape that forms a space for receiving the curing agent therein. The load body 110 may include an inlet 150 through which the curing agent can be injected.

The load body 110 may include a body unit 111 coupled to the front side of the tub 2 and filled with the curing agent therein, an avoidance groove 115 recessed from the front surface of the body unit 111 to avoid a water supply pipe or a detergent supply pipe, and a fastening hole 114 formed to penetrate the body unit 111 so that a fastening member fastened to the tub 2 can pass therethrough.

The body unit 111 may further include a fastening groove 112 recessed in the body unit 111 so that the fastening groove can guide the fastening member and can prevent the fastening member from being exposed to the outside.

The extension unit 120 may commonly include an extension body 121 that extends from the load body 110 farther outward than the outer circumferential surface of the front side of the tub 2. Since the load body 110 is mounted on the front inner circumferential surface of the tub 21, the extension unit 120 should extend backward to surround the side surface of the tub 2. This is because the extension unit 120 needs to extend outward more than the front surface of the tub 2.

The extension body 121 may include a protrusion 122 that extends farther backward than the load body 110 to surround the side surface of the tub 2. In addition, the front surface of the extension body 121 may include a stack recess 123 in which the protruding unit 122 of the other load unit 100 can be seated.

A cross-section of the stack recess 123 may be formed in a shape corresponding to the cross-section of the protrusion 122, and may be recessed or stepped in the front surface of the extension body 121.

The surface of the stack recess 123 may be provided in a shape matched to the exposed surface or the cross-section of protrusion 122. In addition, due to the stack recess 123, the front surface of the extension body 121 may be disposed behind the front surface of the load body 110.

Since the protrusion 122 of the other load unit 100 is seated in the stack recess 123 of any one load unit 100, the plurality of load units 100 may be stacked sequentially. That is, since the plurality of load units 100 can be stacked, the space occupied by the plurality of load units 100 may be minimized, and the plurality of load units 100 can be simultaneously transported.

The outer circumferential surface or the side surface of the extension body 121 may be formed with a curved surface on which a separate configuration can be seated or avoided.

As a result, the first extension unit 120*a* may include a first extension body 121*a* extending farther outward from the load body 110 than the outer circumferential surface of the tub 2.

The first extension body 121*a* may include a first protrusion 122*a* extending farther backward than the load body 110 to surround a side surface of the tub 2. In addition, the first extension body 121*a* may include a first stack recess 123*a* that is recessed or stepped in the front surface of the first extension body 121*a* so that the first protrusion 122*a* can be seated thereon.

As a result, the second extension unit 120*b* may include a second extension body 121*b* extending farther outward from the load body 110 than the outer circumferential surface of the front side of the tub 2.

The second extension body 121*b* may include a second protrusion 122*b* extending farther backward than the load body 110 to surround the side surface of the tub 2. In addition, the second extension body 121*b* may include a second stack recess 123*b* that is recessed or stepped in the front surface of the second extension body 121*b* so that the second protrusion 122*b* can be seated thereon.

Meanwhile, the inlet 150 may be disposed closer to the first extension unit 120*a* than to the second extension unit 120*b*. As a result, the load unit 100 can be easily filled with the curing agent in an upward direction from the lower portion of the load unit 100.

FIG. 6 illustrates the effect of the extension unit 120.

The load body 110 may be disposed inside the load unit 100, and the extension unit 120 may be disposed outside the load unit 100.

The load body 110 may be coupled to the front side of the tub 2, and the extension unit 120 may be exposed to the outside at the front side of the tub 2 so that the extension unit 120 can extend to the side surface of the tub 2.

The load body 110 may be disposed to overlap the front surface of the tub 2 so as not to deviate from the front surface of the tub 2. However, the extension unit 120 may be disposed farther outward than the front surface of the tub 2, and may be disposed to extend farther backward than the load body 110.

The rear surface of the load body 110 and the rear surface of the extension unit 120 may be formed in a shape that is matched with the shape of the front surface of the tub 2 and the shape of the side surface extending from the front surface of the tub 2.

The load body 110 may not be provided with a predetermined thickness or more to avoid interference with either the front panel 13 or the door 135, but the extension unit 120 can extend along the side surface of the tub 2 and can extend to the rear surface of the tub 2.

As a result, if the load body 110 is provided to accommodate a curing agent as much as the first volume V0 at the front side of the tub 2, the extension unit 120 may additionally accommodate a curing agent as much as the second volume V1. Therefore, the load unit 100 may further add a load corresponding to the weight of the curing agent corresponding to the second volume V1 to the tub 2.

In addition, the extension unit 120 may allow the load corresponding to the second volume V1 to be disposed at the rear side of the tub 2 rather than at the front side of the tub 2, and may allow the load corresponding to the second volume V1 to be disposed above the tub 2 rather than below the tub 2.

Therefore, the weight added to the tub 2 is dispersed to the rear and upper portions of the tub 2 rather than to the front and lower portions of the tub 2, so that stability against vibration generated in the tub 2 can be guaranteed.

FIG. 7 is a diagram illustrating the structure of the front and rear surfaces of the load unit 100 according to the present disclosure.

FIG. 7(*a*) shows the front surface of the second load unit 102, and FIG. 7(*b*) shows the rear surface of the second load unit 102, but it should be noted that the first load unit 101 can also be provided in the same manner as in the second load unit 102.

Referring to FIG. 7(*a*), the main body 111 may be provided to be seated on the front surface of the tub 2, and the main body 111 may have a curvature in a manner that the outer surface thereof can correspond to the shape of the outer circumferential surface of the front side of the tub 2.

On the other hand, the extension body 121 may be provided to extend to the side surface of the main body 111 rather than to the front or rear surface of the main body 111.

The extension body 121 may include the stack recess 123 at the front surface thereof, and the protrusion 122 may be provided at the rear surface of the extension body 121.

The cross-sectional shape of the stack recess 123 and the cross-sectional shape of the protrusion 122 may correspond to each other.

As a result, when the plurality of load units 100 is stacked, the main body 122 of the load unit 100 may be seated in the stack recess 123 of the load unit 100.

Specifically, the first stack recess 123*a* may be recessed and provided at the front surface of the first extension body 121*a*. The first stack recess 123*a* may extend while being stepped from the front surface of the main body 111. As a result, the first stack recess 123*a* and the main body 111 may be formed in a stepped shape.

The first stack recess 123*a* may be disposed farther outward than the outer circumferential surface of the front side of the tub body 21.

The second stack recess 123*b* may be recessed and provided at the front surface of the second extension body 121*b*. The second stack recess 123*b* may extend while being stepped from the outer surface of the main body 111. As a result, the second stack recess 123*b* and the main body 111 can be formed in a stepped shape.

The second stack recess 123*b* may be disposed farther outward than the outer circumferential surface of the front side of the tub body 21.

Referring to FIG. 7(*b*), the first protrusion 122*a* may protrude from the rear surface of the first extension body 121*a*. The first protrusion 122*a* and the rear surface of the main body 111 may be provided to have a step difference therebetween. The first protrusion 122*a* and the main body 111 may be formed in a stepped manner.

Referring to FIG. 7B, the first protrusion 122*a* may protrude from the rear surface of the first extended body 121*a*. The first protrusion 122*a* and the rear surface of the main body 111 may be provided to form a step. The first protrusion 122*a* and the main body 111 may be provided in a stepped manner.

When the rear surface of the main body 111 is seated on the front surface of the tub 2, the first protrusion 122*a* may be disposed at the side surface of the tub 2.

The first protrusion 122*a* may have a cross-section corresponding to the cross-section of the first stack recess 122*a*.

As a result, the first protrusion 122*a* may be seated in the first stack recess 122*a*.

The second protrusion 122*b* may protrude from the rear surface of the second extension unit 120*b*. The second protrusion 122*b* and the rear surface of the main body 111 may be provided to have a step difference therebetween. The second protrusion 122*b* and the main body 111 may be formed in a stepped manner.

When the rear surface of the main body 111 is seated on the front surface of the tub 2, the second protrusion 122*b* may be disposed at the side surface of the tub 2.

The second protrusion 122*b* may have a cross-section corresponding to the cross-section of the second stack recess 122*b*.

As a result, the second protrusion 122*b* may be seated in the second stack recess 122*b*.

On the other hand, the protrusion 122 may include a seating portion 142 provided to be seated on the stack recess 123, and the stack recess 123 may include a fixing unit 141 provided to fix the protrusion 122.

The fixing unit 141 may be provided to be accommodated in the seating portion 142. The shape of the fixing unit protruding from the stack recess 123 and the shape of the seating portion 142 recessed in the fixing unit 141 may be formed to correspond to each other.

Of course, the fixing unit 141 may be provided in the protrusion 122, and the seating portion 142 may also be provided in the stack recess 123.

However, since the protrusion 122 protrudes from the load body 110, stress is concentrated at the fixing unit 141 when even the fixing unit 141 protrudes from the load body 110 so that the durability of the extension unit 120 may be reduced. As a result, the fixing unit 141 may be provided in the stack recess 123.

The load unit (100) further includes a fastening unit 140 provided to fix the positions of the plurality of load units (100) to each other when the load units (100) are stacked.

The fastening unit 140 can include the fixing part 141 and the seating portion 142.

FIG. 8 is a diagram illustrating a stacked structure of the plurality of load units 100 according to the present disclosure.

Referring to FIG. 8, the plurality of load units 100 may be stacked together due to the protrusion 122 and the stack recess 123.

For example, when the load unit 100 is stacked on the other load unit 100, the extension unit 120 formed in the upper load unit 100 can be seated on the extension unit 120 of the lower load unit 100.

Specifically, the first protrusion 122*a* provided in the upper load unit 100 may be seated on the first stack recess 123*a* provided in the lower load unit 100, and the second protrusion 122*b* provided in the upper load unit 100 may be seated on the second stack recess 123*a* provided in the lower load unit 100.

Therefore, even if the extension unit 120 is provided in the load unit 100, there may be no problem in stacking the plurality of load units 100.

In addition, since the stack recess 123 extends stepwise to a predetermined depth from the main body 111, the position at which the protrusion 122 is seated in the stack recess 123 is guided, so that the plurality of load units 100 can always be stacked uniformly.

As a result, even when the extension unit 120 extends from the load body 110, the plurality of the load units 100 can be regularly stacked, so that many more load units 100 can be disposed per unit area.

In addition, since a separation distance between the upper main body 111 and the lower main body 111 can be reduced by the depth of the stack recess 123, the volume of the plurality of stacked load units 100 can also be reduced.

In addition, when the fixing unit 142 provided in the stack recess 123 is seated in the seating portion 141 provided in the protrusion 122, the upper load unit 100 can be prevented from sliding in the lower load unit 100. As a result, the effect of receiving (or storing) the plurality of load units 100 can greatly increase.

FIG. 9 illustrates additional features of the load unit 100.

In FIG. 9(*a*), the load unit 100 may include an inlet (injection hole) 150 through which the curing agent can be injected into the load unit 100.

The inlet 150 may be formed at the side surface facing the side panel of the cabinet within the load body 110.

That is, since the rear surface of the load body 110 is provided to face the tub 2, the front surface of the load body 110 is disposed to face forward, and the inlet 150 may be formed at the outer surface of the load body 110.

The inlet 150 may be provided to penetrate the side surface of the load body 110 so that the curing agent can be injected through the inlet 150 (see FIGS. 5 and 6).

However, the inlet 150 may include a cutout portion 152 provided to shield the inlet 150 before the curing agent is inserted into the load body 110. The cutout portion 152 may be formed integrally with the load body 110 to shield the inlet 150, thereby preventing foreign materials from being introduced into the load body 110.

The cutout portion 152 may be provided to be cut in the load body 110. The cutout portion 152 may protrude from the side surface of the load body 110 so that the cutout portion 152 can be easily removed by a cutting machine. In this case, the outer circumferential surface of the cutout portion 152 connected to the load body 110 may correspond to the cutout surface.

Accordingly, the operator (or worker) may cut the protrusion 152 using the cutting machine or the like, resulting in formation of the inlet 150. As a result, when the cutout portion 152 is removed, the inlet 150 may be provided as a through-hole corresponding to the cross-sectional shape of the cutout portion 152 of the load body 110.

On the other hand, the width L1 of the cutout portion 152 may be set to be the same as the lateral width L3 of the load body 110 from which the cutout portion 152 extends. As a result, the cutout portion 152 can be easily manufactured in the load body 110.

On the other hand, when the width L1 of the cutout portion 152 is equal to the lateral width L3 of the load body 110, the curing agent is injected up to a level corresponding to the cutout portion 152, so that the width of the surface formed by the injected curing agent becomes identical to the width of the load body 110. In this case, vibration or external force generated in the tub 2 is transmitted from the inner surface of the load body 110 toward the cutout portion 152, so that pushing force generated by the curing agent can be transmitted to the cutout portion 152.

In this case, among the circumference of the cutout portion 152, a portion facing the front surface of the load body 100 is not supported by the side surface of the load body 110, so that the cutout portion 152 may be easily deformed. As a result, all of the side surface, the front surface, and the rear surface of the load body 110 adjacent to the cutout portion 152 may be twisted and thus deformed.

In this case, the inner surface of the load body 110 and the curing agent may be momentarily separated from each other, and an empty space may be permanently generated inside the load body 110. Due to the empty space located inside the load body 110, noise may be further amplified, or the load body 110 and the curing agent frequently collide with each other due to occurrence of vibration, so that the durability of the load unit 100 may be degraded.

Referring to FIG. 9(*b*), in order to prevent deformation of the load body 110 located adjacent to the cutout portion 152, the inlet 150 may be smaller in size than the width of the surface of the load body 110.

As a result, the entire circumferential surface of the inlet 150 can be supported by the side surface of the load body 110, so that deformation of the load body 110 can be minimized.

Specifically, the width L2 of the cutout portion 152 extending from the load body 110 of the inlet 150 may be smaller than the width L3 of the load body 110. The outer circumferential surface of the cutout portion 152 may be entirely located inside the side surface of the load body 110.

In contrast, the inlet 150 may further include an extension surface 151 that extends obliquely from the side surface of the load body 110 to the outer circumferential surface (a cut surface) of the cutout portion. The cutout portion 152 may protrude outward from the side surface of the load body 110 due to the extension surface 151. In addition, the cutout portion 152 may extend from the inner circumferential surface of the extension surface 151 so that the inner circumferential surface of the extension surface 151 may correspond to the cut surface.

The outer circumferential surface of the extension surface 151 may be connected to the load body 110, and may have a larger area than the outer circumferential surface of the cutout portion 152. As a result, an area of the inner circumferential surface of the extension surface 151 may be smaller than an area of the outer circumferential surface of the extension surface 151.

The extension surface 151 may extend obliquely from the load body 110, or may extend to be curved from the load body 110.

Even if the width L1 of the extension surface and the width L2 of the cutout portion 152 are summed, the sum of the width L1 and the width L2 may be smaller than the width L3 of the outer surface of the load body 110, When the cutout portion 152 is separated from the load body 110, the inner circumferential surface of the extension surface 151 forms a through-hole into which the curing agent is injected.

In this case, since the inner circumferential surface of the extension surface 151 is entirely surrounded by the side surface of the load body 110, it is possible to deformation of minimize the inner circumferential surface of the extension surface 151 by external force.

In addition, since the inner circumferential surface of the extension surface 151 protrudes farther outward than the surface of the load body 110, the installation height of the load body 110 and the installation height of the extension surface 151 may be different from each other, so that external force transmitted to the extension surface 151 may be distributed along the inner circumferential surface of the extension surface 151 at the outer circumferential surface of the extension surface 151. As a result, the durability of the surface of the load body 110 provided with the extension surface 151 may be further increased.

For this reason, even when the curing agent pushes the extension surface 151 by vibration of the tub 2 in a state in which the curing agent is charged to reach a level corresponding to the extension surface 151, the shape of the extension surface 151 can be maximally maintained, and the surface shape of the load body 110 from which the extension surface 151 extends can also be maximally maintained. As a result, it is possible to prevent the curing agent charged in the load body 110 from being spaced apart from the inner surface of the load body 110, thereby preventing an empty space from being formed inside the load body 110.

As a result, the width of the inlet 150 formed in the load unit 100 may be smaller than the width of the surface of the load body 110 on which the inlet 150 is formed.

FIG. 10 is a diagram illustrating that the fastening member is coupled to the load unit 100.

On the other hand, the load unit 100 may be coupled to the front surface of the tub 2 by a fastening member B.

The thickness of the extension unit 120 is larger than the thickness of the load body 110, and the load body 110 is disposed at the front surface of the tub 2, such that it is preferable that the fastening hole 114 and the fastening groove 112 are disposed in the load body 110.

When the fastening member B penetrates the fastening hole 114, the free end of the fastening member B does not protrude farther outward than the fastening groove 112, so that the fastening member B can be minimally exposed to the load unit 100.

On the other hand, a guide surface 113 may allow the fastening member B to be easily introduced into the fastening hole 114, and may allow the outer circumferential surface of the fastening hole 114 and the inner circumferential surface of the fastening groove 112 to extend obliquely so as to strengthen the rigidity of the fastening groove 112.

As a result, the fastening member B can move to the fastening hole 114 along the guide surface 113 after being introduced into the coupling groove 112. In addition, the load applied to the fastening hole 114 and the fastening groove 112 may be distributed according to the inclination of the guide surface 113, thereby strengthening the rigidity of the fastening hole 114 and the fastening groove 112.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

The invention claimed is:

1. A laundry treatment apparatus, comprising:
- a cabinet that defines an opening at a front side thereof;
- a tub that defines a tub inlet configured to communicate with the opening;
- a drum disposed inside the tub and configured to receive laundry;
- a driver coupled to a rear side of the tub and configured to rotate the drum; and
- a load unit that is coupled to a front side of the tub and provides a load to the tub, the load unit comprising:
  - a load body disposed at the front side of the tub, the load body being disposed at a side of the tub inlet, and
  - an extension that extends from the load body and surrounds at least a portion of a side surface of the tub, wherein the extension comprises:
- a first extension that protrudes from the load body and extends toward the side surface of the tub, and
- a second extension disposed downward relative to the first extension, the second extension protruding from the load body and extending toward the side surface of the tub, and wherein a length of the first extension protruding from the load body toward the side surface of the tub is greater than a length of the second extension protruding from the load body toward the side surface of the tub.

2. The laundry treatment apparatus according to claim 1, wherein the load body is disposed between the first extension and the second extension.

3. The laundry treatment apparatus according to claim 2, wherein the first extension protrudes from a first end of the load body, and wherein the second extension protrudes from a second end of the load body spaced apart from the first end of the load body.

4. The laundry treatment apparatus according to claim 3, wherein the first extension is disposed upward relative to a center of the tub inlet, and wherein the second extension is disposed downward relative to the center of the tub inlet.

5. The laundry treatment apparatus according to claim 2, wherein the first extension is disposed upward relative to the second extension, and wherein the first extension is disposed closer to the driver than the second extension is disposed.

6. The laundry treatment apparatus according to claim 1, wherein the extension comprises an extension body that extends outward relative to an outer circumferential surface of the front side of the tub, and wherein the extension body comprises:
- a protrusion that extends rearward relative to the load body and surrounds at least a portion of the side surface of the tub, and
- a stack recess that is recessed from a front surface of the extension body and configured to support a part of another load unit.

7. The laundry treatment apparatus according to claim 6, wherein a shape of the stack recess corresponds to a cross-section of the protrusion.

8. The laundry treatment apparatus according to claim 6, further comprising a fixing unit disposed at the stack recess and configured to fix the protrusion, wherein the protrusion comprises a seating portion supported by the fixing unit.

9. The laundry treatment apparatus according to claim 8, wherein the fixing unit protrudes from the stack recess, and wherein the seating portion is recessed from the protrusion and accommodates at least a portion of the fixing unit.

10. The laundry treatment apparatus according to claim 6, wherein the load body is disposed between the first extension and the second extension, wherein the first extension comprises:

a first extension body that extends outward relative to the outer circumferential surface of the front side of the tub, a first protrusion that extends rearward relative to the load body and surrounds at least a first portion of the side surface of the tub disposed at the first extension body, and a first stack recess recessed from a front surface of the first extension body, and wherein the second extension comprises:

a second extension body that extends outward relative to the outer circumferential surface of the front side of the tub, a second protrusion that extends rearward relative to the load body and surrounds at least a second portion of the side surface of the tub disposed at the second extension body, and a second stack recess recessed from a front surface of the second extension body.

11. The laundry treatment apparatus according to claim 1, wherein the load unit defines an injection inlet configured to receive a curing agent into the load body, and wherein a width of the injection inlet is less than a width of the load body.

12. The laundry treatment apparatus according to claim 11, wherein the load unit has an extension surface that extends obliquely relative to a surface of the load unit and defines an outer circumferential surface of the injection inlet.

13. The laundry treatment apparatus according to claim 1, wherein the load unit further comprises:

a fastening unit, comprising a fastening member that is coupled to the front side of the tub and passes through the front side of the tub, and wherein the fastening unit defines:

a guide surface that extends obliquely inward from the load body, and a fastening hole that passes through an inner circumferential surface of the guide surface and receives the fastening member.

14. The laundry treatment apparatus according to claim 1, further comprising a plurality of load units that comprise (i) a first load unit disposed at a first side of the tub inlet with respect to a reference line passing through a center of the tub inlet and (ii) a second load unit disposed at a second side of the tub inlet opposite to the first side with respect to the reference line, wherein the load unit is one of the first load unit or the second load unit.

15. The laundry treatment apparatus according to claim 1, wherein a volume of the first extension is greater than a volume of the second extension.

16. The laundry treatment apparatus according to claim 1, wherein, based on the length of the first extension and the length of the second extension, a center of gravity of the load unit is defined at a position closer to the first extension than to the second extension.

17. A laundry treatment apparatus, comprising:

a cabinet that defines an opening at a front side thereof;

a tub that defines a tub inlet configured to communicate with the opening;

a drum disposed inside the tub and configured to receive laundry;

a driver coupled to a rear side of the tub and configured to rotate the drum; and a plurality of load units that are coupled to a front side of the tub and provide a load to the tub, the plurality of load units comprising (i) a first load unit disposed at a first side of the tub inlet with respect to a reference line passing through a center of the tub inlet and (ii) a second load unit disposed at a second side of the tub inlet opposite to the first side with respect to the reference line, wherein each of the first load unit and the second load unit comprises:

a load body disposed at the front side of the tub, the load body being disposed at a side of the tub inlet, and an extension that extends from the load body and surrounds at least a portion of a side surface of the tub, wherein the extension comprises:

a first extension that protrudes from the load body and extends toward the side surface of the tub, and a second extension disposed downward relative to the first extension, the second extension protruding from the load body and extending toward the side surface of the tub, and wherein a length of the first extension protruding from the load body toward the side surface of the tub is greater than a length of the second extension protruding from the load body toward the side surface of the tub.

18. The laundry treatment apparatus according to claim 17, wherein the load body is disposed between the first extension and the second extension.

19. The laundry treatment apparatus according to claim 18, wherein the first extension protrudes from a first end of the load body, and wherein the second extension protrudes from a second end of the load body spaced apart from the first end of the load body.

20. The laundry treatment apparatus according to claim 19, wherein the first extension is disposed upward relative to the center of the tub inlet, and wherein the second extension is disposed downward relative to the center of the tub inlet.

* * * * *